US006568575B1

(12) United States Patent
Bartholomew

(10) Patent No.: US 6,568,575 B1
(45) Date of Patent: May 27, 2003

(54) HARNESS ASSEMBLY WITH DETACHABLE AND INTERCHANGEABLE POUCHES

(76) Inventor: Robert Bartholomew, 4160 Louisiana St., Unit H, San Diego, CA (US) 92104

( * ) Notice: Subject to any disclaimer, the term of this patent is extended or adjusted under 35 U.S.C. 154(b) by 0 days.

(21) Appl. No.: 10/038,358

(22) Filed: Jan. 7, 2002

(51) Int. Cl.[7] ..... A45F 5/00

(52) U.S. Cl. ..... 224/583; 224/258; 224/260; 224/640; 224/647; 224/649; 224/655; 224/656

(58) Field of Search ..... 224/583, 250, 224/258, 260, 637, 640, 647, 649, 655, 656

(56) References Cited

U.S. PATENT DOCUMENTS

| | | | | | |
|---|---|---|---|---|---|
| 469,444 | A | * | 2/1892 | Frazier | 224/641 |
| 770,761 | A | * | 9/1904 | Lemly | 224/649 |
| 3,583,611 | A | * | 6/1971 | Theodore | 224/624 |
| 3,739,961 | A | * | 6/1973 | Soukeras | 224/579 |
| 4,944,438 | A | * | 7/1990 | Gallagher | 224/624 |
| 5,184,764 | A | * | 2/1993 | Orovan et al. | 224/636 |
| 5,205,450 | A | * | 4/1993 | Derosier | 224/161 |
| 5,483,860 | A | * | 1/1996 | Adams | 84/327 |
| 5,533,655 | A | * | 7/1996 | Duque | 224/602 |
| 5,642,842 | A | * | 7/1997 | Taras | 224/250 |
| 5,775,558 | A | * | 7/1998 | Montalbano | 224/627 |
| 6,016,944 | A | * | 1/2000 | Girbert | 224/646 |
| 6,213,365 | B1 | * | 4/2001 | Stocke et al. | 224/665 |
| 6,216,931 | B1 | * | 4/2001 | Trawinski | 224/583 |
| 6,390,346 | B1 | * | 5/2002 | Thomas | 224/605 |

* cited by examiner

*Primary Examiner*—Stephen P. Garbe
(74) *Attorney, Agent, or Firm*—Charles C. Logan, II

(57) ABSTRACT

A harness with detachable and interchangeable pouches comprises two torso straps extending downwardly and outwardly from a central coupler assembly, two shoulder straps, and two belly straps. The harness is adjustable to fit nearly any body size. The pouches are attached to the harness with quick-releasing retaining clips and to each other by the belly straps. Each pouch includes front and rear panels that are formed using either a right-side template or a left-side template and is interchangeable with any other pouch designed using the same template. The interchangeability allows the wearer to install pouches that are best suited for a particular activity. Each pouch is designed such that, when worn, it hangs at an angle which causes its top to slant downwardly toward the middle of the wearer's torso, thereby increasing the accessibility of the pouch contents.

10 Claims, 5 Drawing Sheets

HARNESS ASSEMBLY WITH DETACHABLE AND INTERCHANGEABLE POUCHES

FIELD OF THE INVENTION

The present invention relates generally to wearable storage assistance. More specifically, the present invention pertains to pocket harnesses which can be used to carry numerous items on one's person. The present invention is particularly, though not exclusively, useful as a means by which a user may comfortably and easily carry a variety of items on his or her person while engaging in physical activity.

BACKGROUND OF THE INVENTION

As a result of today's desire to be physically fit, many people are pursuing outdoor activities which involve strenuous physical activity. Many of these outdoor hobbies, such as cycling or hiking, require a person to carry a multitude of necessary items. It is the common practice to wear a back-pack to store the necessary items. Wearing a back-pack, however, limits the accessibility of the items which are being carried within it. Most times a person must cease the activity in which he or she is engaged, remove the back-pack to open it and retrieve the item. For example, to retrieve an item from a back-pack the average cyclist must usually stop the bike and dismount in order to take off the back-pack so that he or she can access its storage compartments. Consequently, the pocketed harness was invented. Such a device, as disclosed in U.S. Pat. No. 5,775,558, which issued to Montalbano for an invention entitled "Harness-Type Securing System For Personal Equipment," consists of an X-back harness, two shoulder straps, a waist strap, and a plurality of pouches which can be attached to the waist strap. The problem with this invention, however, is that the waist strap is worn at the same level as the user's belt causing the pouches to hang down past the user's waist. These pouches then tend to brush against the user's upper leg area and are at best an annoyance. Moreover, if such a harness was worn while engaged in the activities described above, it is likely that the pouches would interfere with the user's movement. Additionally, accessing the storage pouches while engaging in such an activity would be extremely difficult.

Another such device, as disclosed in U.S. Pat. No. 5,129,560, which issued to Herman for an invention entitled "Utility Bag System", consists of two storage bags connected by a neck strap and a waist strap. The device is worn in such a way that the storage bags are suspended adjacent the user's chest. Again, this invention is problematic and unlikely to be worn while engaging in any sort of physical activity because the storage bags are bulky and likely to hinder movement of the user's arms. Moreover, the pockets would be difficult to access.

Accordingly, it is the object of the present invention to provide a harness with storage pouches which can be worn by the user while engaged in physical activity that requires a person to carry numerous items. It is another object of the present invention to provide a harness with storage pouches that is comfortable and does not interfere with the user's motion while engaged in such activities. It is also an object of the present invention to provide a harness with storage pouches in which the storage pouches may be interchanged with alternative storage pouches depending upon what the user is carrying on his or her person. It is an additional object of the present invention to provide a harness with storage pockets that are readily adapted to any sort of activity in which it is necessary to have items close at hand. It is a further object of the present invention to provide a harness with storage pockets that are placed in such a manner to make them readily accessible while engaged in the above mentioned physical activity. It is another object of the present invention to provide a harness that is easily adjustable to fit nearly any body size. It is yet another object of the present invention to provide a harness with storage compartments that are easy to use, relatively easy to manufacture and is comparatively cost effective.

SUMMARY OF THE INVENTION

In accordance with the present invention, a harness with detachable and interchangeable pouches is provided which includes a harness assembly worn by the user. The harness assembly consists of two or more torso straps extending downwardly and outwardly from a central coupler, two shoulder straps, and two or more belly straps for securing the harness.

The harness with the detachable and interchangeable pouches also include two detachable pouches which are incorporated into the strapping system. Each detachable pouch has an upper male retainer clip and a lower male retainer clip. The upper male retainer clips mate with the female retainer clips which are securely fastened to the shoulder straps. The lower male retainer clips mate with female retainer clips which are securely fastened to the lower back straps. Attached to each detachable pouch is a belly strap with two opposing ends for securing the harness in place around the wearer's upper body. Each belly strap has a semi-permanent fastener at one end and a male or female retainer clip at the other end. Each belly strap is affixed to a detachable pouch with a fastener which is inserted through a hole in the belly strap and through a hole located in the detachable pouch. These belly straps then extend from the detachable pouches and meet in the middle of the wearer's torso allowing the male and female retainer clips to mate with each other and secure the harness in place about the wearer.

Each detachable pouch has one or more pockets which are generally formed with a front face, a rear face, a bottom and two side walls. The top of the pockets can be closed with a variety of means, but regardless of the means chosen the detachable pouch is designed in such a way that when it is fastened to the harness system the pockets hang at an angle causing the top of the pockets to slant downward toward the middle of the wearer's torso. This slanted configuration of the pocket openings greatly improves accessibility of what ever is contained within the detachable pouches. Additionally the pocket angles may be adjusted to suit the wearers by lengthening or shortening equidistantly both shoulder straps and torso straps simultaneously.

Additionally, the basic design for the detachable pouches stems from either a right-side generic template or a left-side generic template. Any detachable pouch based on the right-side generic is interchangeable with any other detachable pouch designed from that template. Similarly, any detachable pouch designed from the left-side generic template is interchangeable with any other detachable pouch based on that template. Depending on the activity the wearer is engaged in, he or she can configure the harness with detachable and interchangeable pouches to best suit the needs of the activity.

The harness with detachable and interchangeable pouches is configured in such a manner it can be easily adjusted to nearly any body size. Further, when worn, the detachable pouches are located to the front of the wearer's torso between the chest and the waist and will not hinder the movement of the user's arm and legs.

The harness with detachable and interchangeable pouches of the present invention overcomes many of the disadvantages of the previous pocketed harnesses. More specifically, the present invention provides a harness which is comfortable and easily adaptable to numerous applications. The present invention can be worn when engaged in nearly any outdoor physical activity which requires numerous items to be readily located at hand, such as outdoor hobbies and jobs. The incorporation of detachable and interchangeable pouches of the present invention allows the present invention to be worn in a multitude of configurations. Additionally, when the present invention is worn it maintains the storage pouches at a level on the users body which does not interfere with the user's upper body motion. Finally, the present invention provides storage pouches which are easily accessible and do not require the wearer to interrupt his or her activity in order to retrieve an item from one of the uniquely placed pouches.

DESCRIPTION OF THE PREFERRED EMBODIMENT

Figure 1:
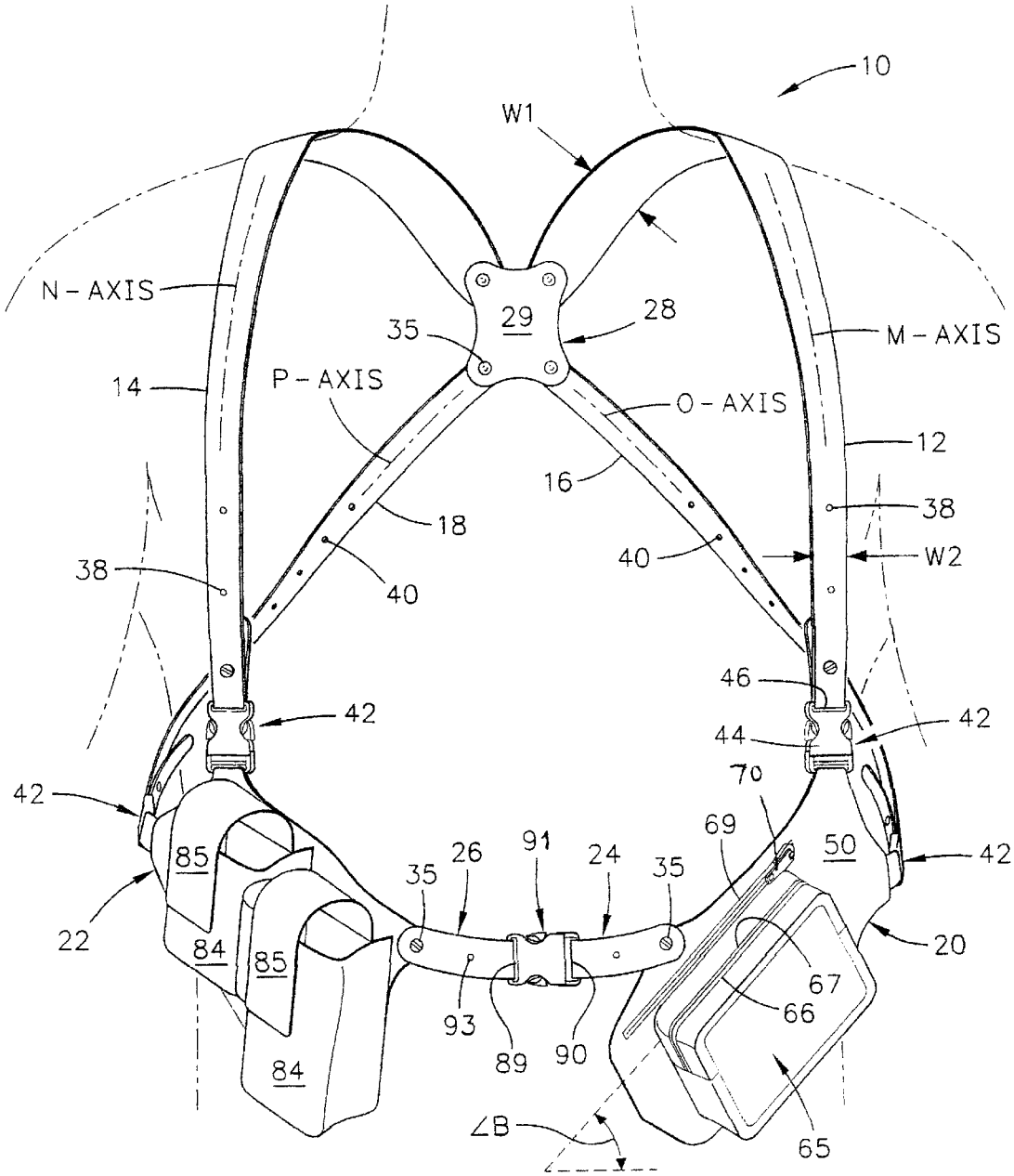
FIG. 1 is a front perspective view of the harness assembly with detachable and interchangeable pouches.

The harness assembly with detachable and interchangeable pouches will now be described by referring to FIGS. 1–5 of the drawings. The harness assembly in FIG. 1 is generally designated numeral 10. It has a left shoulder strap 12, a right shoulder strap 14, a left torso strap 16, a right torso strap 18, a left side pouch assembly 20, a right side pouch assembly 22, a left belly strap 24 and a right side belly strap 26.

Figure 1B:
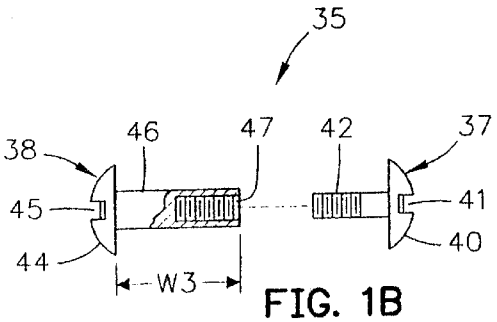
FIG. 1B is an enlarged exploded side elevation view of one of the disassembable fastener assemblies.
Figure 1A:
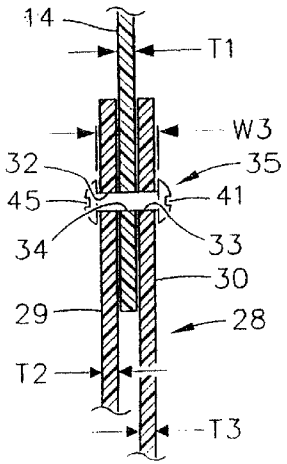
FIG. 1A is an enlarged schematic cross section view illustrating the manner in which the strap members are pivotally connected to the central strap coupler assembly.
Figure 3:
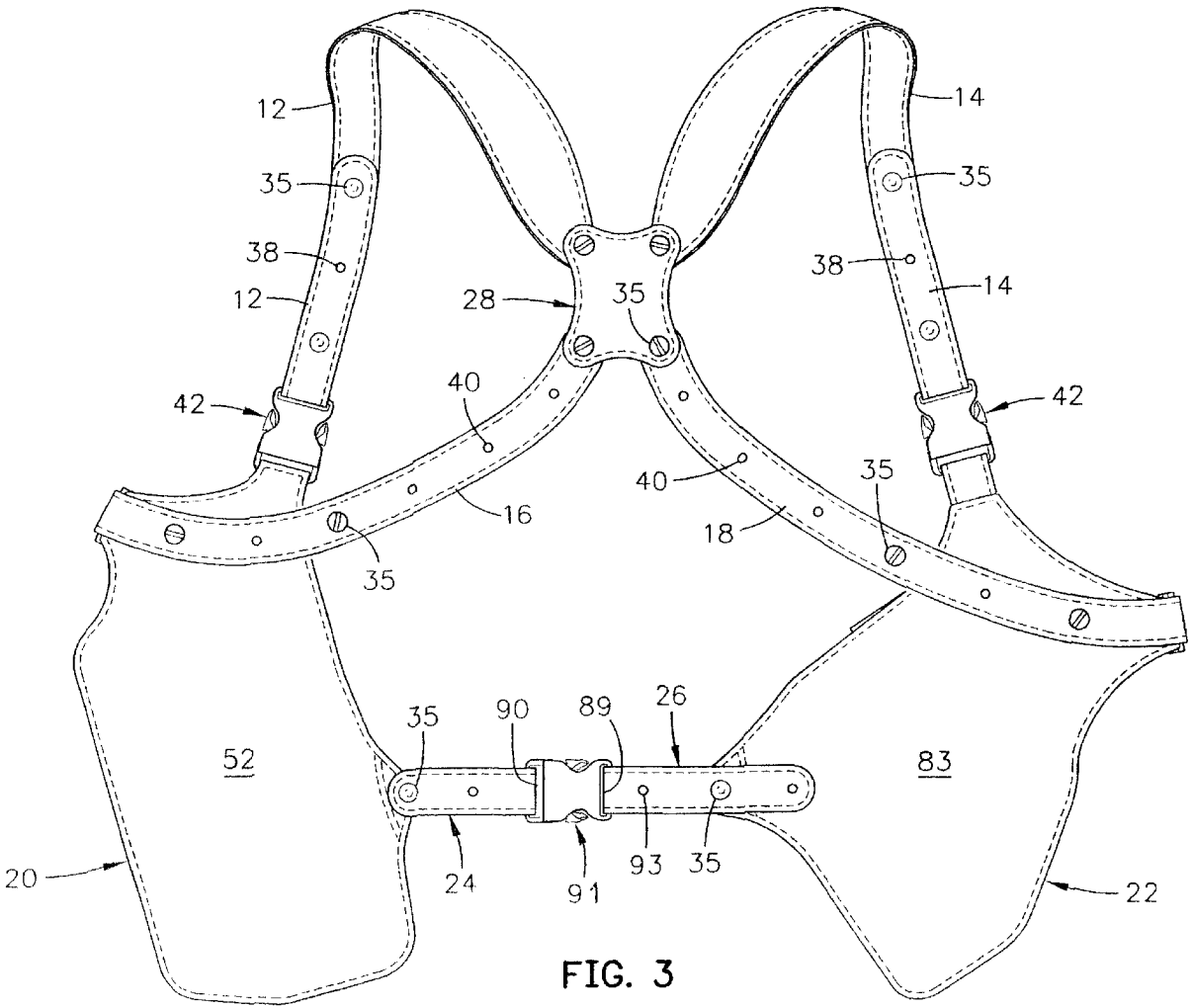
FIG. 3 is a rear elevation view of the harness assembly with detachable and interchangeable pouches.

Central strap coupler assembly 28 and the manner in which the rear ends of the straps 12, 14, 16 and 18 are freely pivotally connected thereto are best understood by referring to FIGS. 1, 1A and 1B. Central strap coupler assembly 28 has a front panel 29 spaced forwardly of a rear panel 30. The respective panels each have a configuration whose perimeter has four side edges with corners between the respective side edges. Aligned apertures 32 and 33 (FIG. 1A) removably receive fastener assemblies 35. Each of the rear ends of the respective strap members has an aperture 34 through which the fastener assembly 35 is inserted. The rear ends of the respective strap members has a thickness T1. Front panel 29 has a thickness T2 and rear panel 30 has a thickness T3. The fastener assemblies 35 have a male member 37 and a female member 38. Male member 37 has a head 40 having a groove 41. It also has an externally threaded shank portion 42. Female member 38 has a head 44 having a slot 45. It has a shank portion 46 having an internally threaded bore 47. When male member 37 is fully threaded into female member 38, there is a width W3 between the respective heads 40 and 44. W3 is greater than the sum total of T1, T2 and T3 so that the rear ends of the respective strap members can freely pivot with respect to front panel 29 and rear panel 30 of central strap coupler assembly 28. This allows the straps to freely angularly orient themselves to person's having different sized torsos.

Left shoulder strap 12 (FIG. 1) has a longitudinally extending M-axis and right shoulder strap 14 has a longitudinally extending N-axis. Shoulder straps 12 and 14 have a width W1 adjacent their rear end that is greater than their width W2 adjacent their front end. A plurality of apertures 38 are formed adjacent the front end of the respective shoulder straps 12 and 14. Torso straps 16 and 18 have the respective longitudinally extending O-axis and P-axis. A plurality of apertures 40 are formed adjacent the front end of the torso straps 16 and 18.

Figure 4:
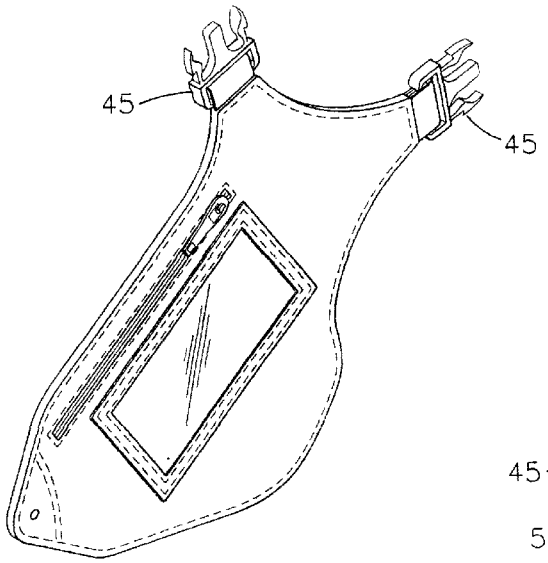
FIG. 4 is a front perspective view of a first alternative embodiment of the left side pouch assembly.
Figure 4A:
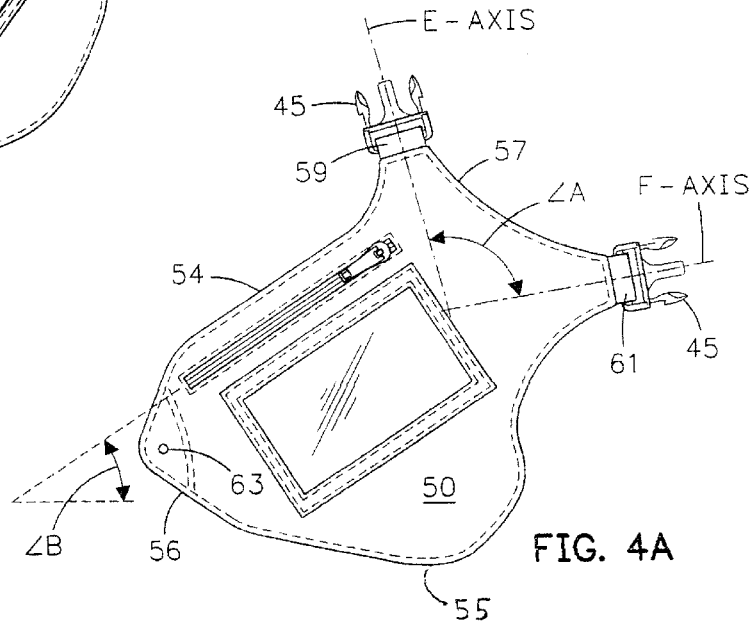
FIG. 4A is a front elevation view of the first alternative embodiment of the left side pouch assembly.
Figure 4B:
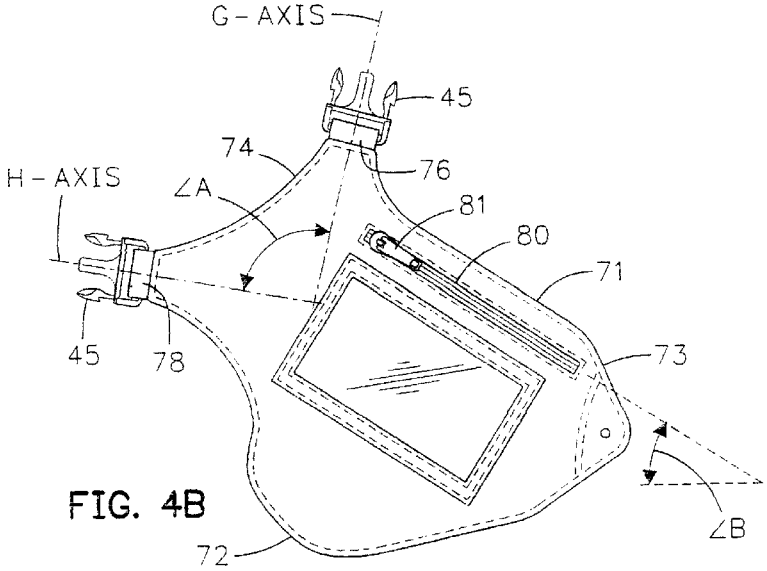
FIG. 4B is a front elevation view of a first alternative embodiment of a right side pouch assembly configured similarly to the first alternative embodiment illustrated in FIGS. 4 and 4A.

A left side pouch assembly 20 (FIG. 1) and a right side pouch assembly 22 are detachably secured to the front end of the respective straps 12, 14, 16 and 18 by releasable buckle fasteners 42. Each of these releasable buckle fasteners have a female retainer clip member 44 and a male retainer clip member 45 (FIGS. 4A and 4B). Slots 46 (FIG. 1) are formed adjacent one end of the female retainer clip members 44 and through these slots are threaded the front ends of the respective straps which are then folded back upon each other to a position where the respective apertures 38 and 38 or 40 and 40 are aligned with each other for receiving one of the fastener assemblies. This also allows for flexibility in adjusting the length of the straps to accommodate person's having different sized torsos, thereby changing the pocket angles relative to horizontal.

Each of the pouch assemblies 20 has a similar front panel 50 (FIG. 1) and a rear panel 52 (FIG. 3) formed from left side templates. They are stitched together along their perimeter. The specific structure of the left side pouch assembly 20 will now be described. It is also advisable that FIGS. 4 and 4A be viewed since they show a left side pouch assembly isolated from the rest of the structure of the harness assembly 10. Each pouch assembly has an upper edge 54, a lower edge 55, a front edge 56 and a rear edge 57. A closed loop strap 59 having an E-axis is permanently secured to a male retainer clip member 45 that releasably locks into a female retainer clip member 44 (FIG. 1) attached to the front end of left shoulder strap 12 (FIG. 1). A closed loop strap 61 extends from the perimeter of left side pouch assembly 20 and it has an F-axis. The E-axis and F-axis intersect each other at an angle A that is approximately 90°. A male retainer clip member 45 is secured to the front end of closed loop strap 61 and it removably locks into the front end of a female retaining clip 44 (FIG. 1) attached to the front end of left torso strap 16. The manner of adjusting the length of left torso strap 16 is identical to that utilized for the left shoulder strap 12. An aperture 63 is formed in the front end of left side pouch assembly 20 adjacent the intersection of its front edge 56 and upper edge 54. Its importance will be discussed later.

A pouch 65 (FIG. 1) having an opening 66 that is closed by a zipper 67 is attached to front wall 50 and it forms a receptacle for storing different items. An opening 69 closed by a zipper 70 also forms a second storage area in left side pouch assembly 20. Both of the respective openings 66 and 69 and upper edge 54 (FIG. 4A) are sloped downwardly and inwardly at an acute angle B to a horizontal plane. This allows the person wearing the harness assembly to more easily access items from the respective storage chambers. The structure illustrated in FIGS. 4 and 4A shows a slightly different version of a left side pouch assembly. FIG. 4B shows a right side pouch assembly that is substantially identical to that illustrated in FIG. 4A but reversed. It has an upper edge 71, a lower edge 72, a front edge 73 and a rear edge 74. It has a closed loop strap 76 having a G-axis and a male retainer clip member 45 is secured thereto. A closed loop strap 78 has a H-axis with a male retainer clip member 45 secured thereto. The G-axis and the H-axis intersect each other at an angle A that is approximately a 90° angle. Opening 80 with a zipper 81 are part of a storage chamber in the right side pouch assembly. Upper edge 71 and opening 80 are oriented at an acute angle B to a horizontal plane in the same manner as described previously with respect to left side pouch assembly 20.

Right side panel assembly 22 (FIG. 1) has a front panel 82 (FIG. 2) and a rear panel 83 (FIG. 3) whose construction is similar to that of left side pouch assembly 20 (FIG. 1). A pair of open top end pockets 84 are stitched or otherwise secured to the front panel 82 of right side pouch assembly 22. Each has a closure strap 85. The upper edge of pockets 84 and an upper edge 71 (FIG. 2) of the front and rear panels are oriented at an acute angle B (FIGS. 4A and 4B) to a horizontal plane to make access to the pockets 84 (FIGS. 1 and 2) easier for the person wearing the harness assembly. It is to be fully understood that the pockets 84 and pouches 65 (FIG. 1) are merely illustrative of a single design of storage structure and other structures could be utilized by retaining the essential structure of the respective front and rear panels of the respective left side and right side pouch assemblies.

Figure 2:
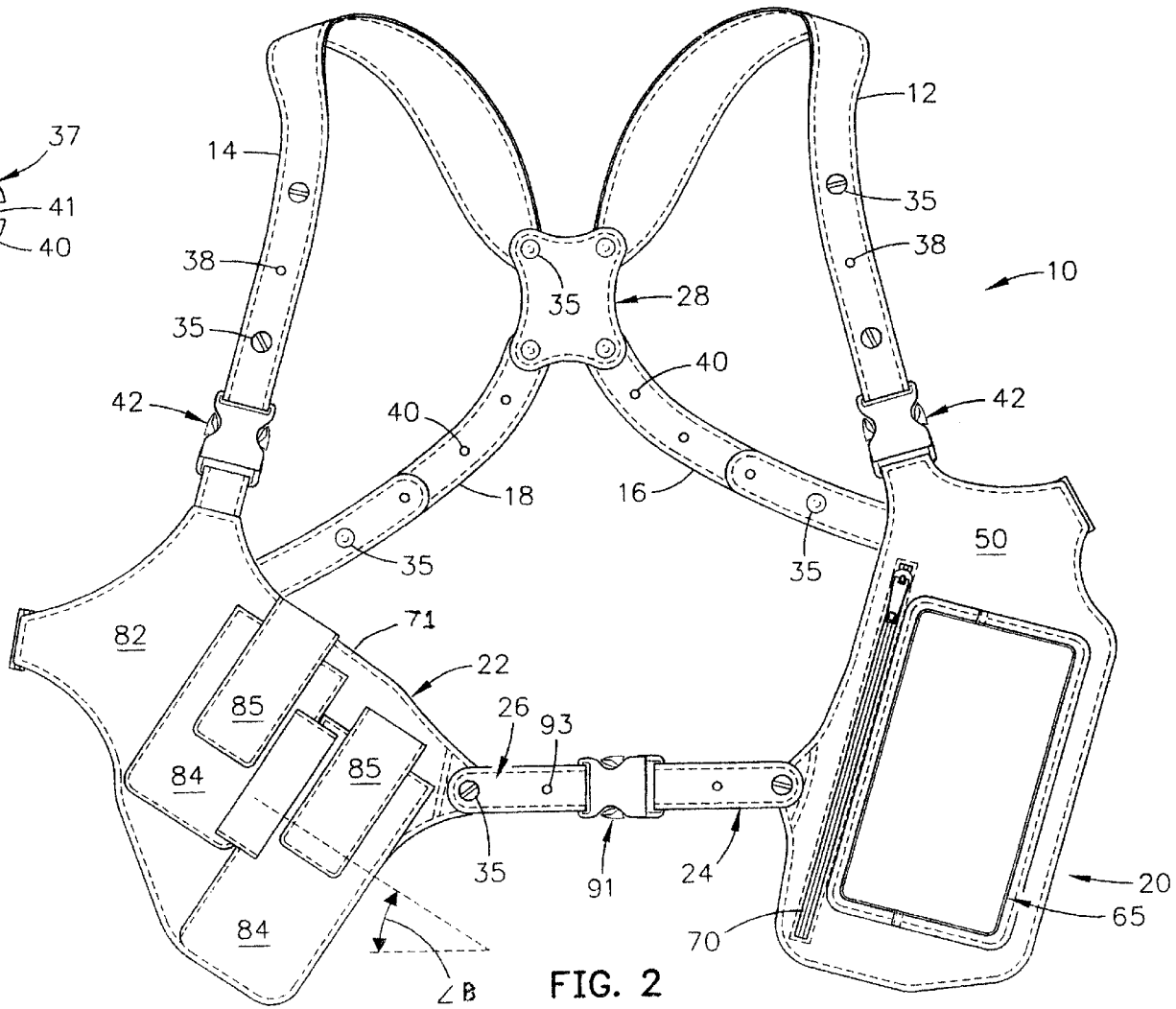
FIG. 2 is a front elevation view of the harness assembly with detachable and interchangeable pouches.
Figure 5:
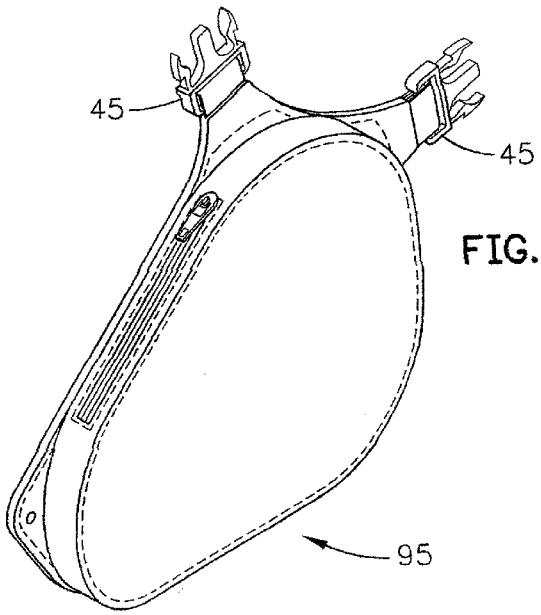
FIG. 5 is a front perspective view of a second alternative embodiment of the left side pouch assembly.
Figure 5A:
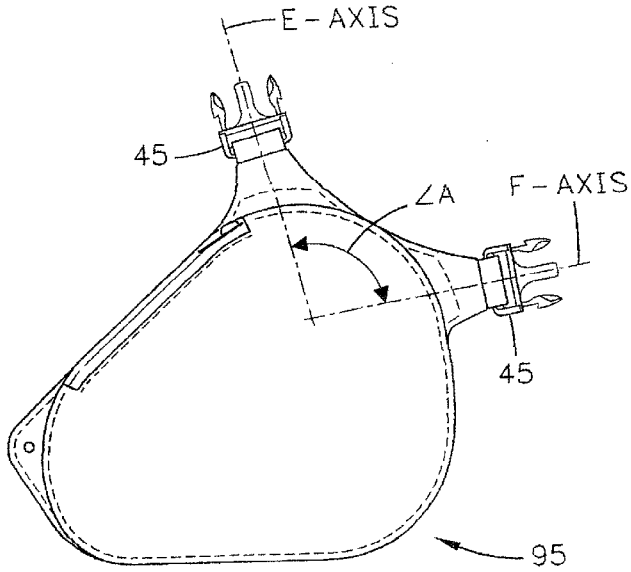
FIG. 5A is a front elevation view of the second alternative embodiment of the left side pouch assembly.
Figure 5B:
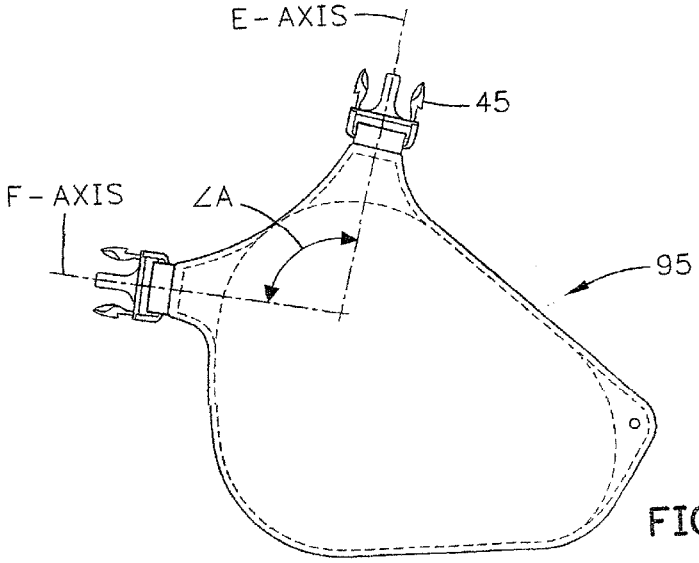
FIG. 5B is a front elevation view of a second alternative embodiment of a right side pouch assembly configured similar to the second alternative embodiment illustrated in FIGS. 5 and 5A.

The left and right belly straps 24 and 26 are substantially identical and they are fed through the respective slots 89 and 90 of the male and female retaining clip members of releasable buckle 91 (FIGS. 1 and 2). Each of the belly straps has a plurality of apertures 93. The apertures at the front end of the respective belly straps would be aligned with the apertures found adjacent the front end of the respective left side and right side pouch assemblies 20 and 22. Fastener assemblies 35 (FIG. 1A) allows the two ends of each of the respective belly straps to freely pivot about their respective apertures. FIGS. 5 and 5A illustrate a second alternative embodiment of the left side pouch assembly that is designated numeral 95. FIG. 5B is a rear elevation view of the second embodiment illustrated in FIG. 5A.

What is claimed:

1. A harness assembly with detachable and interchangeable pouches comprising:

an elongated left shoulder strap having a front end, a rear end, an aperture adjacent said rear end, a thickness T1, a width W1 adjacent said rear end, a width W2 adjacent said front end, at least three longitudinally spaced apertures adjacent said front end for length adjustment purposes and a longitudinally extending M-axis;

an elongated right shoulder strap having a front end, a rear end, an aperture adjacent said rear end, a thickness T1, a width W1 adjacent said rear end, a width W2 adjacent said front end, at least three longitudinally spaced apertures adjacent said front end for length adjustment purposes and a longitudinally extending N-axis;

an elongated left torso strap having a front end, a rear end, an aperture adjacent said rear end, a thickness T1, at least three longitudinally spaced apertures adjacent said front end for length adjustment purposes and a longitudinally extending O-axis;

an elongated right torso strap having a front end, a rear end, an aperture adjacent said rear end, a thickness T1, at least three longitudinally spaced apertures adjacent said front end for length adjustment purposes and a longitudinally extending P-axis;

a central strap coupler assembly comprising a front panel and a rear panel that are not attached to each other; said front and rear panels each having four perimeter edges that form four corners; an aperture is formed adjacent said respective comers in said respective front and rear panels; said front panel having a thickness T2 and said rear panel having a thickness T3;

four central strap coupler assembly fasteners each comprising a front head portion, a rear head portion and a shank portion extending between said respective head portions having a length W3; said fasteners securing said rear ends of said left shoulder strap, said right shoulder strap, said left torso strap and said right torso strap to said respective four apertures in said central strap coupler assembly; said respective rear ends of said four strap members being sandwiched between said respective front and rear panels and dimension W3 is greater than the sum of T1, T2 and T3 so that said respective rear ends of said strap members are freely pivotal between said front and rear panels of said central strap coupler assembly so that said straps can freely seek the angular orientation needed to properly fit different sized individuals;

a left side panel assembly comprising a rear panel, a front panel having an outer surface, said panels being attached to each other; said left side panel assembly having an upper edge, a lower edge, a rear edge, and a front edge; said upper edge has an acute angular orientation with respect to a horizontal plane when said left side panel assembly is detachably secured to said front ends of said respective left shoulder strap and said left torso strap; an E-axis closed loop strap extends up from said left side panel assembly adjacent said intersection of said upper edge and said rear edge; an F-axis closed loop strap extends rearwardly from said left side panel assembly adjacent said intersection of said rear edge and said lower edge; said E-axis and said F-axis intersect each other at an approximately 90 degree angle; an aperture is formed in said left side panel adjacent said intersection of said upper edge and said front edge; said left side panel assembly having an article storing structure having an upper edge; an opening is formed in said article storage structure and said opening has an acute angular orientation to a horizontal plane that makes it easier for a person wearing said harness to store and access articles placed in said article storage structure;

a right side panel assembly comprising a rear panel, a front panel having an outer surface, said panels being attached to each other; said right side panel assembly having an upper edge, a lower edge, a rear edge, and a front edge; said upper edge has an acute angular orientation with respect to a horizontal plane when said right side panel assembly is detachably secured to said front ends of said respective right shoulder strap and said right torso strap; a G-axis closed loop strap extends up from said right side panel assembly adjacent said intersection of said upper edge and said rear edge; an H-axis closed loop strap extends rearwardly from said right side panel assembly adjacent said intersection of said rear edge and said lower edge; said G-axis and said H-axis intersect each other at an approximately 90 degree angle; an aperture is formed in said right side panel adjacent said intersection of said upper edge and said front edge; said right side panel assembly having an article storing structure having an upper edge; an opening is formed in said article storage structure and said opening has an acute angular orientation to a horizontal plane that makes it easier for a person wearing said harness to store and access articles placed in said article storage structure;

first quick disconnect means connecting said front end of said left shoulder strap to said E-axis closed loop strap; second quick disconnect means connecting said front end of said left torso strap to said F-axis closed loop strap; third quick disconnect means connecting said front end of said right shoulder strap to said G-axis closed loop strap; fourth quick disconnect means for connecting said front end of said right torso strap to said H-axis closed loop strap;

a left belly strap having a front end and a rear end; means for pivotally securing said rear end of said left belly strap to said aperture adjacent said front end of said left side panel assembly;

a right belly strap having a front end and a rear end; means for pivotally securing said rear end of said right belly strap to said aperture adjacent said front end of said right side panel assembly; and fifth quick disconnect means connecting said front end of said left belly strap to said front end of said right belly strap.

2. A harness assembly with detachable and interchangeable pouches as recited in claim 1 wherein said article storing structure on said left side panel assembly is a pouch having a zipper for closing said opening in said article storage structure.

3. A harness assembly with detachable and interchangeable pouches as recited in claim 1 wherein said article storing structure on said right side panel assembly is an open pocket pouch having a closure flap.

4. A harness assembly with detachable and interchangeable pouches as recited in claim 1 wherein said fasteners are disassembleable and reassembleable.

5. A harness assembly with detachable and interchangeable pouches as recited in claim 1 wherein said width W1 of said rear end of said left and right shoulder straps is greater than said width W2 of said front end of said left and right shoulder straps.

6. A harness assembly with detachable and interchangeable pouches as recited in claim 1 wherein said straps, said central strap coupler assembly, said panel assemblies and said pouches are made of nylon material.

7. A harness assembly with detachable and interchangeable pouches as recited in claim 1 wherein said straps, said central strap coupler assembly said panel assemblies and said pouches are made of leather material.

8. A harness assembly with detachable and interchangeable pouches as recited in claim 1 wherein said straps, said central strap coupler assembly, said panel assemblies and said pouches are made of artificial leather material.

9. A harness assembly with detachable and interchangeable pouches as recited in claim 1 wherein said left and right shoulder straps have means for adjusting their length.

10. A harness assembly with detachable and interchangeable pouches as recited in claim 1 wherein said left and right shoulder straps have means for adjusting their length.

* * * * *